US006336259B1

(12) United States Patent
Stahlecker

(10) Patent No.: US 6,336,259 B1
(45) Date of Patent: Jan. 8, 2002

(54) APPARATUS AND METHOD FOR CONDENSING A DRAFTED FIBER STRAND

(75) Inventor: Hans Stahlecker, Haldenstrasse 20, 73079 Süssen (DE)

(73) Assignees: Fritz Stahlecker, Bad Uberkingen; Hans Stahlecker, Sussen, both of (DE)

( * ) Notice: Subject to any disclaimer, the term of this patent is extended or adjusted under 35 U.S.C. 154(b) by 0 days.

(21) Appl. No.: 09/580,115

(22) Filed: May 30, 2000

(30) Foreign Application Priority Data

May 28, 1999 (DE) ..... 199 24 527

(51) Int. Cl.[7] ..... D01H 5/86

(52) U.S. Cl. ..... 19/246; 19/150; 19/236; 57/315

(58) Field of Search ..... 19/150, 236–253, 19/262, 263, 266, 273, 277, 281, 286, 287, 288, 304–308; 57/264, 304, 315, 328, 333

(56) References Cited

U.S. PATENT DOCUMENTS 1,559,281 A * 10/1925 Rushton ..... 19/251
4,391,021 A * 7/1983 Kamel ..... 19/253
4,398,320 A * 8/1983 Kubota et al. ..... 19/236
4,557,022 A * 12/1985 Morishita et al. ..... 19/281
5,184,374 A * 2/1993 Barauke et al. ..... 19/262
6,108,873 A * 8/2000 Barauke ..... 19/236

FOREIGN PATENT DOCUMENTS

DE 197 08 410 A1 9/1998

* cited by examiner

*Primary Examiner*—John J. Calvert
*Assistant Examiner*—Gary L. Welch
(74) *Attorney, Agent, or Firm*—Crowell & Moring LLP

(57) ABSTRACT

A condensing zone for condensing a drafted fiber strand is arranged downstream of the front roller pair of a drafting apparatus of a ring spinning machine. The condensing zone includes a stationary sliding surface having a suction slit, over which the fiber strand is transported by a perforated transport belt. The condensing zone is bordered on its exit side by a nipping roller which is disposed on the transport belt. The nipping roller drives the transport belt and is in turn driven by a friction roller. The friction roller is pressed, by means of a loading spring, onto the nipping roller as well as onto a roller of the front roller pair of the drafting apparatus.

39 Claims, 3 Drawing Sheets

VI
39
38
36
29
27
37
31
30
10
32
21
8
5
23
13
33
12
A
11
34
24
15
18
17
B
14
19
6
1
4
25
2
3

16
14
2
15
3
19
17
12
38
A
B
11
39
25
33
36
34
8
21
27
29
1
10

APPARATUS AND METHOD FOR CONDENSING A DRAFTED FIBER STRAND

This application claims the priority of German application 199 24 527.4, filed in Germany on May 28, 1999.

BACKGROUND AND SUMMARY OF THE INVENTION

The present invention relates to an apparatus for condensing a drafted fiber strand in a condensing zone arranged downstream of the front roller pair of a drafting unit, which condensing zone comprises a stationary sliding surface having a suction slit extending essentially in transport direction of the fiber strand, and a perforated transport belt which transports the fiber strand over the sliding surface, on which transport belt a nipping roller, bordering the exit side of the condensing zone, is disposed.

In the case of an apparatus of this type (German published patent application 197 08 410), the nipping roller is the upper roller of a delivery roller pair, whose bottom roller is looped by the transport belt. The bottom roller in turn is driven by a further drive roller which extends in machine longitudinal direction, so that at the end of the condensing zone three rollers in total are arranged one over the other. This design, which requires a separate drive shaft und gearing from the headstock of the ring spinning machine, is considerably complicated and, in particular, does not permit already existing ring spinning machines to be retrofitted with a condensing zone.

It is an object of the present invention to simplify the complicated drive design for the transport belt, thus creating an opening for existing ring spinning machines not having a condensing zone to be retrofitted with same.

This object has been achieved in accordance with the present invention in that the nipping roller drives the transport belt, the nipping roller in turn being driven by a friction roller, which is pressed, by means of a loading spring, to the nipping roller and also to a roller of the front roller pair.

A friction drive of this type is very simple and makes it possible in particular to maintain to a great extent the peripheral speed of the front roller pair also at the nipping roller. This takes into consideration the fact that the fiber strand has left the drafting unit and should not be additionally drafted in the condensing zone. In addition, a friction drive of this kind is suitable for retrofitting existing ring spinning machines having no condensing zones with same.

Although it is possible that the friction roller, as well as the nipping roller, is disposed at the same time on the driven bottom roller of the front roller pair, it is particularly purposeful when the friction roller is disposed on the upper roller of the front roller pair. It is then possible to arrange the loading spring at the top arm of the drafting unit, which results in a very simple design.

In the case of an apparatus of this type (German published patent application 197 08 410), the nipping roller is the upper roller of a delivery roller pair, whose bottom roller is looped by the transport belt. The bottom roller in turn is driven by a further drive roller which extends in machine longitudinal direction, so that at the end of the condensing zone three rollers in total are arranged one over the other. This design, which requires a separate drive shaft and gearing from the headstock of the ring spinning machine, is considerably complicated and, in particular, does not permit already existing ring spinning machines to be retrofitted with a condensing zone.

The nipping roller can also be designed in a variety of ways. The nipping roller can have a flexible coating, which is provided for the drive effected by the friction roller as well as for the drive of the transport belt. The nipping roller can alternatively be so designed that the flexible coating has two areas, one for the drive effected by the friction roller and one for the drive of the transport belt. The two areas can have in addition different diameters, so that the area with an enlarged diameter driving the transport belt effects a certain tension draft on the fiber strand.

The friction roller, which is advantageously designed as a pressure roller, can have a fitted collar. This makes it possible to design the friction roller simultaneously as a cleaning device for the nipping roller and/or for the upper roller of the front roller pair. The cleaning device can, for example, comprise a lamellar ring fitted onto the collar of the friction roller.

These and further objects, features and advantages of the present invention will become more readily apparent from the following detailed description thereof when taken in conjunction with the accompanying drawings.

DETAILED DESCRIPTION OF THE DRAWINGS

Figure 1:
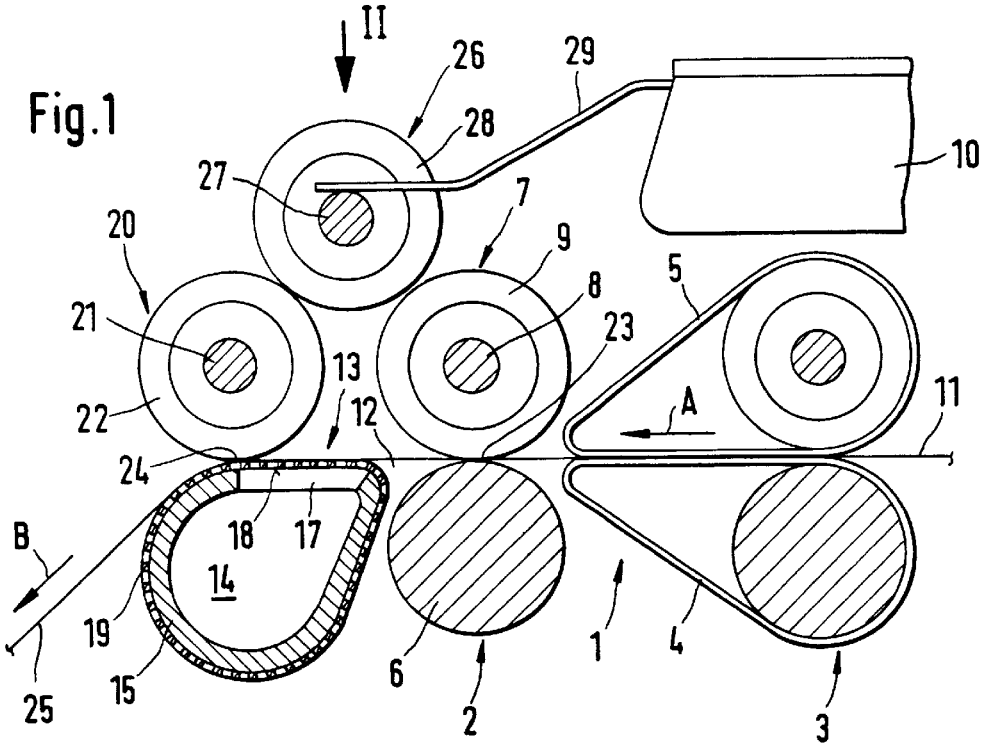
FIG. 1 is a part sectional schematic side view through an apparatus for condensing a fiber strand, constructed according to a preferred embodiment of the present invention.
Figure 2:
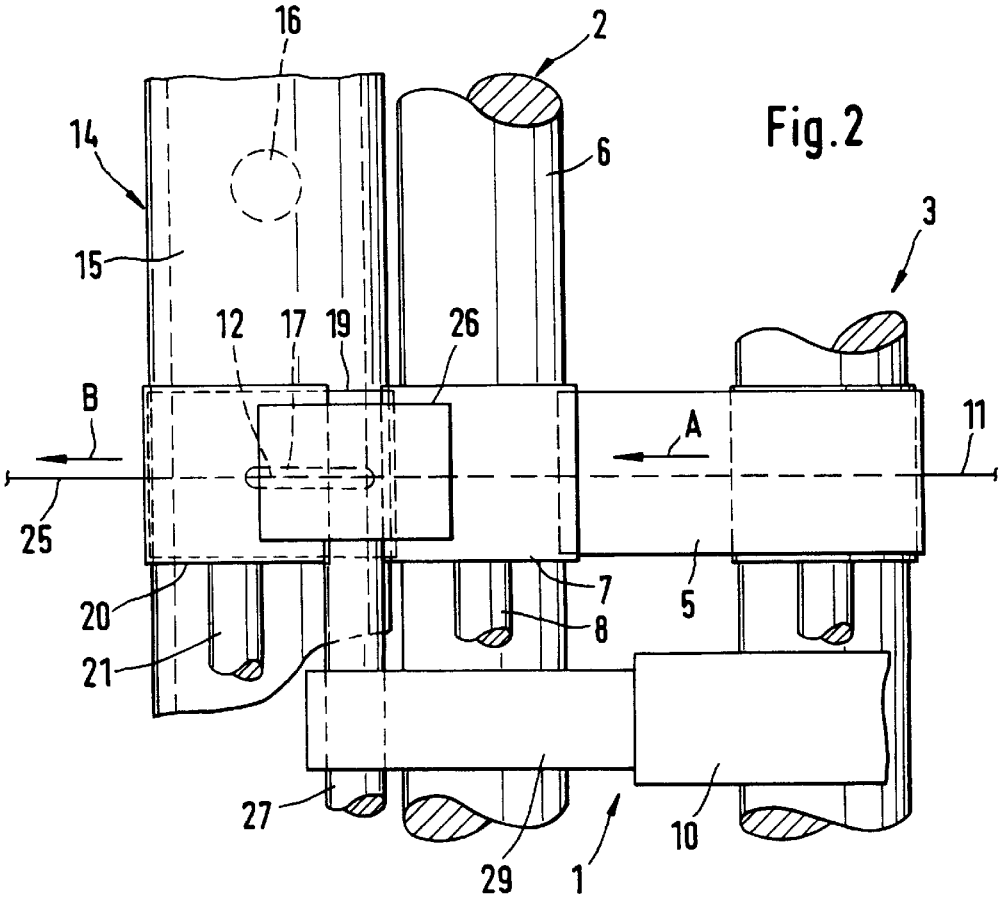
FIG. 2 is a view in the direction of arrow II of FIG. 1.

The apparatus for condensing a drafted fiber strand 12 shown in FIGS. 1 and 2 is a component part of a ring spinning machine. The apparatus is connected to a drafting unit 1 present at each spinning station of the ring spinning machine, of which essentially only the front roller pair 2 and the apron roller pair 3 arranged upstream of the front roller pair 2 in transport direction A are shown. A bottom apron 4 and an upper apron 5 can be seen.

The front roller pair 2 comprises a driven bottom cylinder 6 extending in machine longitudinal direction, and an upper roller 7 arranged at each spinning station. The upper rollers 7 of two adjacent spinning stations are joined together to form a pressure roller pair by means of a joint axle 8 in a way not further shown, as is mostly the case in operating machines. The upper roller 7 comprises a flexible coating 9, which presses against the bottom cylinder 6. The upper rollers 7, joined together to form a pressure roller pair, are mounted in a top arm 10 (indicated only) by means not shown.

In the drafting unit 1, a sliver or roving 11 is drafted to the desired degree of fineness and transported through the drafting unit 1 in transport direction A. Directly downstream of the front roller pair 2, a ready drafted fiber strand 12 is present, which is to be further condensed by means of bundling in a condensing zone 13 downstream thereof. In this condensing zone 13, the fiber strand 12 is not yet provided with a spinning twist. During condensing, the outermost fibers of the fiber strand 12 are deposited on the core strand, so that the thread 25 leaving the condensing zone 13 is less hairy, and thus smoother and hereby also more tear-resistant.

The condensing zone 13 comprises a suction device 14, which is formed essentially by a hollow section 15 extending over a plurality of spinning stations. A suction connection 16 is arranged for a plurality of spinning stations, which leads to a vacuum source (not shown). In the hollow section 15, one suction slit 17 is applied per spinning station, which suction slit 17 faces the fiber strand 12 to be condensed and which extends essentially in transport direction A. The width of the suction slit 17 is significantly larger than the diameter of the condensed fiber strand 12.

The outer contour of the hollow section 15 forms a stationary sliding surface 18 for an air-permeable transport belt 19, which is advantageously designed as a very fine-pored and thin woven belt, and which transports the fiber strand 12 over the sliding surface 18 and the suction slit 17.

The condensing zone 13 is bordered on an exit side by a nipping roller 20, which presses the fiber strand 12 and the transport belt 19 against the sliding surface 18 and which acts hereby as a twist block for the thread 25 to be subsequently twisted. The axle 21 (indicated only) of the nipping roller 20 can also be mounted in the top arm 10 in a way not further shown here.

The nipping roller 20 comprises a flexible coating 22, which can be designed similarly to the flexible coating 9 of the upper roller 7. The nipping roller 20 forms, together with the hollow section 15, a nipping point 24, so that the condensing zone 13 is located entirely between a nipping point 23 of the front roller pair 2 as well as the above mentioned nipping point 24. In order that the condensing effect does not lessen before the nipping point 24 is reached, the suction slit 17 is guided at least to the nipping point 24. From this point on, the thread 25 to be twisted is fed in delivery direction B to a ring spindle (not shown).

The speeds of the fiber strand 12 should be essentially the same at the two nipping points 23 and 24. This can be achieved in that, according to the present invention, the drive is derived from the front roller pair 2 and transferred by means of a friction roller 26 to the nipping roller 20.

The friction roller 26, whose axle 27 is also mounted in a way not shown in the top arm 10, presses against the upper roller 7 of the front roller pair 2 as well as against the nipping roller 20. The axle 27 of the friction roller 26 is loaded with a loading spring 29 affixed in the top arm 10.

In the specific embodiment shown in FIGS. 1 and 2, the friction roller 26 has an elastomer coating 28, which can correspond to the flexible coatings 9 and 22 of the upper roller 7 and the nipping roller 20. In the case of this embodiment, it is also provided that the flexible coating 22 of the nipping roller 20 has an area which is provided for the drive by the friction roller 26 as well as for the drive of the transport belt 19. The friction drive 26, which thus receives its drive from the upper roller 7, drives the nipping roller 20, which in turn drives the transport belt 19.

In the embodiments described below, those components which are identical with those in FIGS. 1 and 2, shall not be described again, and the identical components shall be denoted by the same reference numbers.

Figure 3:
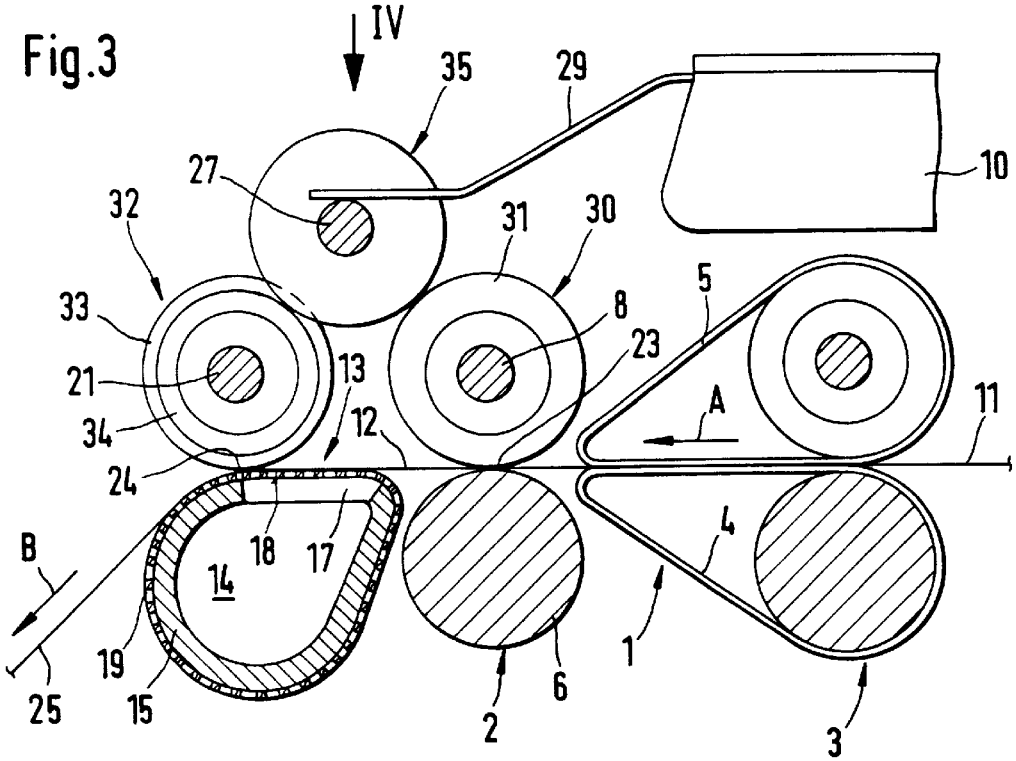
FIG. 3 is a view similar to FIG. 1 of another embodiment of the friction wheel and the nipping roller.
Figure 4:
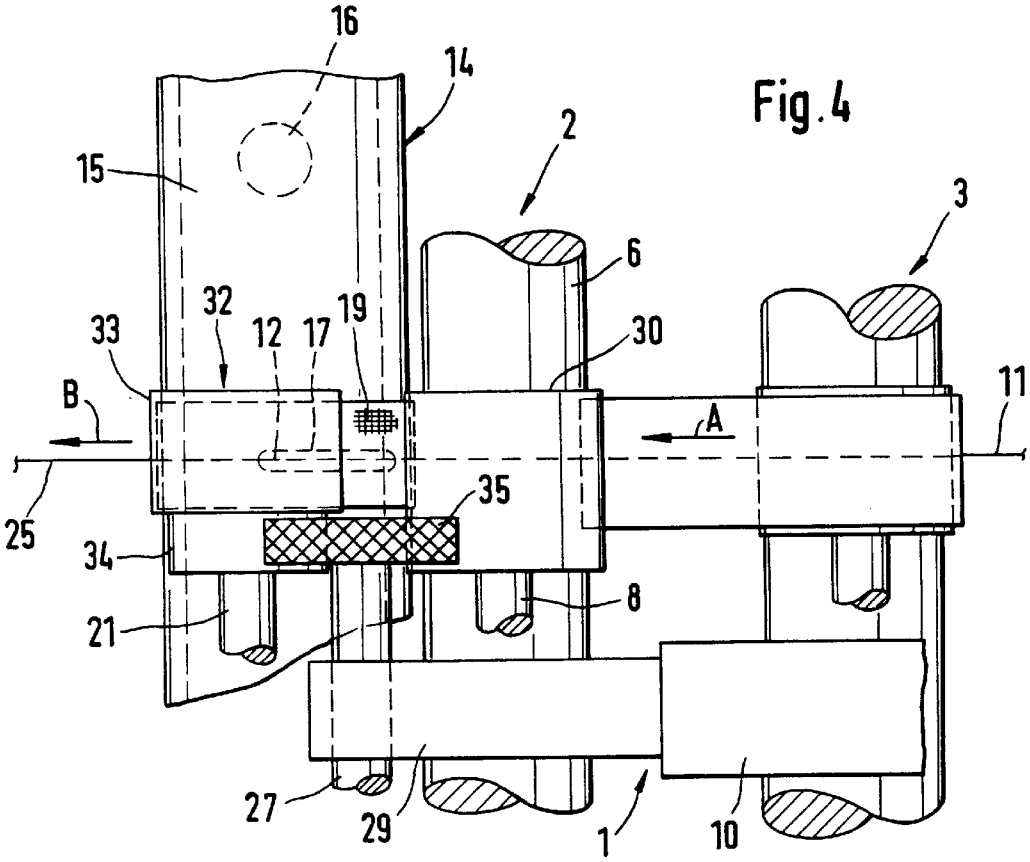
FIG. 4 is a view in the direction of the arrow IV of FIG. 3.

In the embodiment to be described according to FIGS. 3 and 4, the only changes in contrast to the variations described above are essentially a differently designed upper roller 30 of the front roller pair 2, a differently designed nipping roller 32 as well as a differently designed friction roller 35. The upper roller 30 differs from the upper roller 7 only in a somewhat extended flexible coating 31.

The nipping roller 32 now has two different areas 33 and 34 of the flexible coating, whereby these two areas 33 and 34 have in addition two different diameters, which does not necessarily have to be the case. The area 34 with the smaller diameter serves the drive by the friction roller 35, while the area 33 with the larger diameter is arranged at the spinning area and drives the transport belt 19. Due to these differing diameters it is possible to apply a small tension pull to the fiber strand 12 to be condensed in the condensing zone 13.

The friction roller 35 is narrower in this embodiment of the present invention than the variations described above and is made of steel, even on its outer periphery. The friction roller 35 is knurled or fluted on its peripheral area, so that a good frictional effect is attainable. The friction roller 35 is hereby pressed against the area 34. A separation of drive and spinning area is thus provided.

Figure 5:
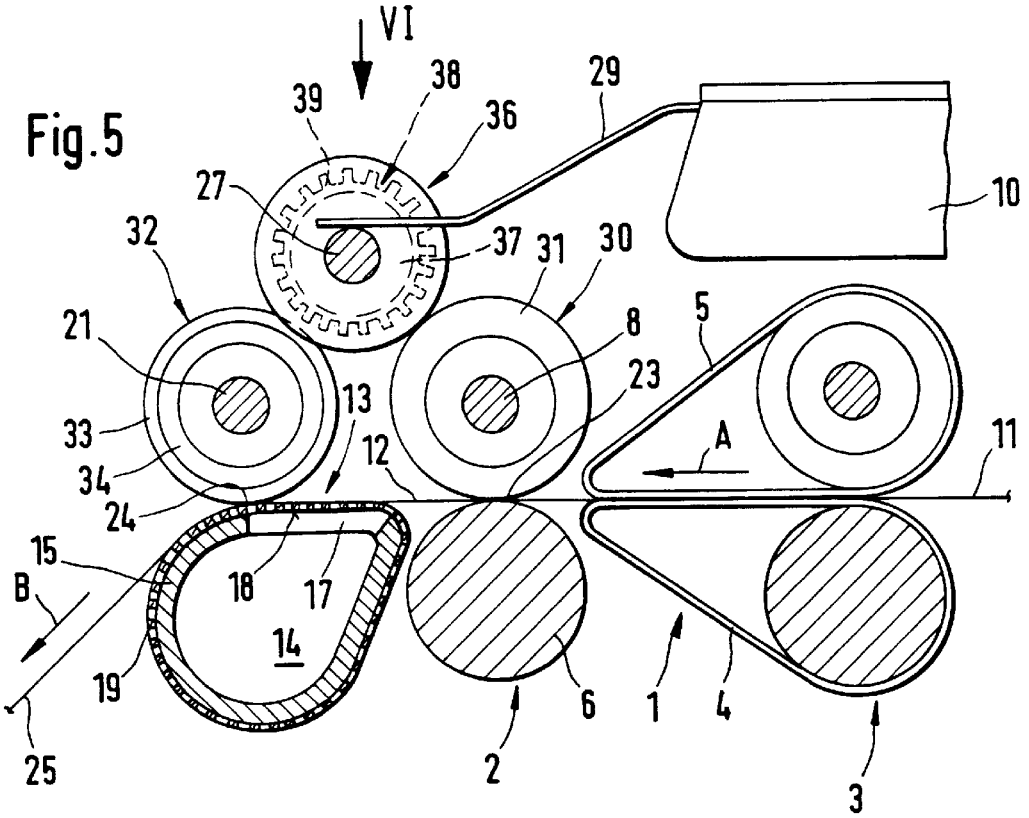
FIG. 5 is a view similar to FIG. 3 of a friction roller comprising a cleaning device.
Figure 6:
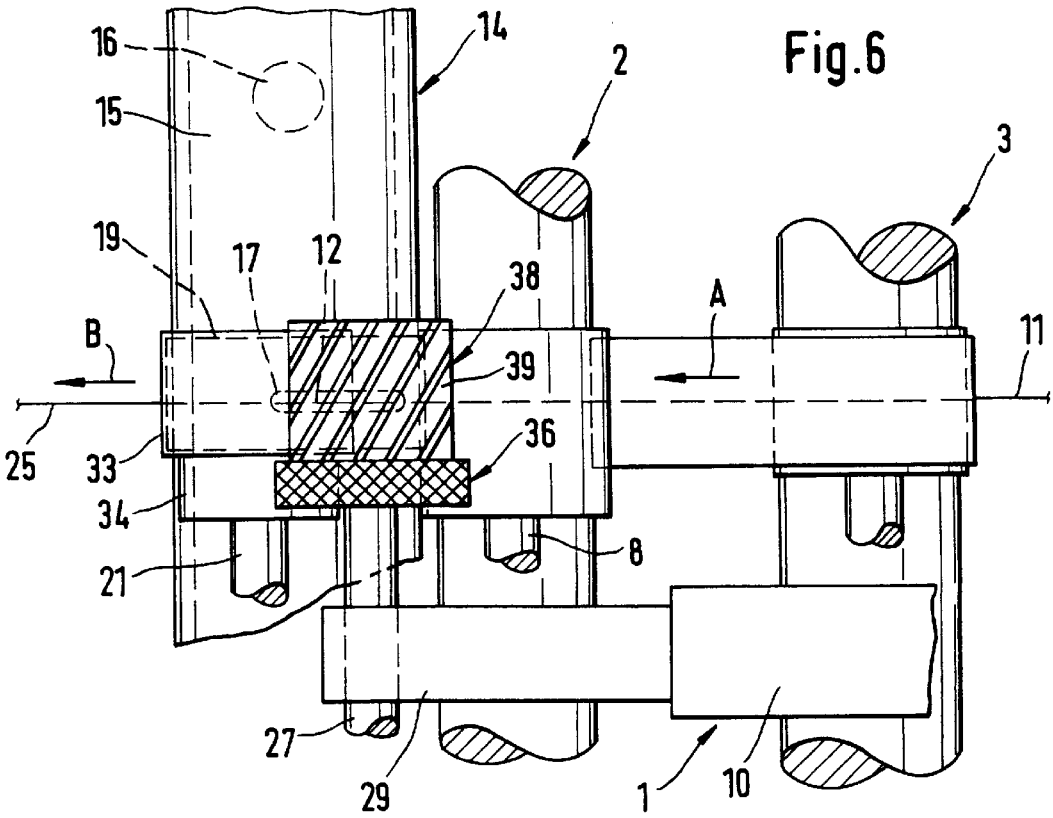
FIG. 6 is a view in the direction of the arrow VI of FIG. 5.

The embodiment according to FIGS. 5 and 6 corresponds to a great extent to the embodiment according to FIGS. 3 and 4, whereby only a somewhat modified friction roller 36 is provided.

The friction roller 36 is again designed as a pressure roller and is provided with a fitted collar 37. This collar 37 serves to take up a lamellar ring 39, which acts as a cleaning device 38.

The friction roller 36, as in the embodiment according to FIGS. 3 and 4, also presses here with a knurled or fluted steel ring against an area 34 of the nipping roller 32 as well as against an extended area of the flexible coating 31 of the upper roller 30, whereas a lamellar ring 39 is arranged at the spinning area, the outer diameter of the lamellar ring 39 corresponding to the area 33 of the nipping roller 32 with the enlarged diameter. Due to the different peripheral speeds between the lamellar ring 39 and the area 33, the lamellar ring 39 acts with light pressure as a cleaning device 38.

In a way not shown, the flexible coating 31 of the upper roller 30 can be provided with different diameters in such a way that the lamellar ring 39 also cleans the periphery of the upper roller 30 during operation.

In all embodiments the suction slit 17 is shown as extending in transport direction A. However, it should be noted that it was found out that favorable condensing results are obtained with a design in which the suction slit 17 deviates from the transport direction A by an angle of about 5° to about 12°.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for condensing a drafted fiber strand in a condensing zone arranged downstream of a front roller pair of a drafting unit, which condensing zone comprises a stationary sliding surface having a suction slit extending essentially in transport direction of the fiber strand, and a perforated transport belt which transports the fiber strand over the sliding surface, on which transport belt a nipping roller, bordering an exit side of the condensing zone, is disposed, wherein said nipping roller is in driving engagement with the transport belt, wherein a friction roller is provided which is in driving engagement with the nipping roller, wherein a loading spring is provided for pressing the friction roller onto the nipping roller as well as onto a roller of the front roller pair, and wherein the nipping roller has at least two areas of differing diameters, of which one area is provided for the drive by the friction roller and the at least one other area is provided for a tension draft which acts on the fiber strand.

2. An apparatus according to claim 1, wherein the friction roller is disposed on an upper roller of the front roller pair.

3. An apparatus according to claim 2, wherein the loading spring is arranged at a top arm of the drafting unit.

4. An apparatus according to claim 3, wherein the friction roller is provided with an elastomer coating.

5. An apparatus according to claim 3, wherein the friction roller is provided with a knurled or fluted steel surface.

6. An apparatus according to claim 2, wherein the friction roller is provided with an elastomer coating.

7. An apparatus according to claim 2, wherein the friction roller is provided with a knurled or fluted steel surface.

8. An apparatus according to claim 2, wherein the friction roller comprises a cleaning device for the nipping roller and/or the upper roller of the front roller pair.

9. An apparatus according to claim 8, wherein the cleaning device comprises a lamellar ring.

10. An apparatus according to claim 9, wherein the cleaning device comprises a lamellar ring.

11. An apparatus according to claim 1, wherein the friction roller is provided with an elastomer coating.

12. An apparatus according to claim 1, wherein the friction roller is provided with a knurled or fluted steel surface.

13. An apparatus according to claim 1, wherein the friction roller is disposed on a flexible coating of the nipping roller.

14. An apparatus according to claim 13, wherein the flexible coating of the nipping roller has an area which is provided for the drive by the friction roller as well as for the drive of the transport belt.

15. An apparatus according to claim 13, wherein the flexible coating of the nipping roller has two areas, of which one area is provided for the drive by the friction roller and the other area is provided for the drive of the transport belt.

16. An apparatus according to claim 1, wherein the friction roller is designed as a pressure roller with a fitted collar.

17. A method of retrofitting a ring spinning machine with a condensing zone, comprising:

in stalling a condensing unit down stream of a ring spinning machine drafting unit which has a front drafting roller pair at an exit end of the drafting unit, said condensing unit including a stationary sliding surface member with a suction slit and a belt slidable over the sliding surface, a condensing zone nipping roller drivingly engaging the transport belt and forming an exit end of the condensing zone, and installing a friction roller to be drivingly engageable with both one roller of the front drafting roller pair and the condensing zone nipping roller, wherein the nipping roller has at least two areas of differing diameters, of which one area is provided for the drive by the friction roller and the at least one other area is provided for a tension draft which acts on the fiber strand.

18. A method according to claim 17, wherein the friction roller is disposed on an upper roller of the front roller pair.

19. A method according to claim 18, wherein a loading spring is arranged at a top arm of the drafting unit for loading the friction roller.

20. A method according to claim 17, wherein the friction roller is provided with an elastomer coating.

21. A method according to claim 17, wherein the friction roller is provided with a knurled or fluted steel surface.

22. A method of making yarn comprising:

drafting a fiber strand in a drafting unit which has a front roller pair at an exit end of the drafting unit, condensing the fiber strand in a condensing unit disposed downstream of the drafting unit by passing the fiber strand over a perforated belt which is slidable on a sliding surface member with a suction slit, said condensing unit including a condensing zone nipping roller at an exit end of the condensing unit, and applying twist to the fiber strand in a ring spinning unit dispose downstream of the condensing zone, wherein said condensing includes utilizing a friction roller simultaneously engaging a roller of the front roller par of the drafting unit and the condensing zone nipping roller, wherein the nipping roller has at least two areas of differing diameters, of which one area is provided for the drive by the friction roller and the at least one other area is provided for a tension draft which acts on the fiber strand.

23. An apparatus for condensing a drafted fiber strand in a condensing zone arranged downstream of a front roller pair of a drafting unit, which condensing zone comprises a stationary sliding surface having a suction slit extending essentially in transport direction of the fiber strand, and a perforated transport belt which transports the fiber strand over the sliding surface, on which transport belt a nipping roller, bordering an exit side of the condensing zone, is disposed, wherein said nipping roller is in driving engagement with the transport belt, wherein a friction roller is provided which is in driving engagement with the nipping roller, wherein a loading spring is provided for pressing the friction roller onto the nipping roller as well as onto a roller of the front roller pair, wherein the friction roller is disposed on a flexible coating of the nipping roller, wherein the flexible coating of the nipping roller has an area which is provided for the drive by the friction roller as well as for the drive of the transport belt, and wherein the flexible coating of the nipping roller has two areas, of which one area is provided for the drive by the friction roller and the other area is provided for the drive of the transport belt.

24. An apparatus according to claims 23, wherein the friction roller is disposed on an upper roller of the front roller pair.

25. An apparatus according to claim 24, wherein the loading spring is arranged at a top arm of the drafting unit.

26. An apparatus according to claim 24 wherein the friction roller comprises a cleaning device for the nipping roller and/or the upper roller of the front roller pair.

27. An apparatus according to claim 23, wherein the friction roller is provided with an elastomer coating.

28. An apparatus according to claim 23, wherein the friction roller is provided with a knurled or fluted steel surface.

29. An apparatus according to claim 23, wherein the friction roller is designed as a pressure roller with a fitted collar.

30. An apparatus for condensing a drafted fiber strand in a condensing zone arranged downstream of a front roller pair of a drafting unit, which condensing zone comprises a stationary sliding surface having a suction slit extending essentially in transport direction of the fiber strand, and a perforated transport belt which transports the fiber strand over the sliding surface, on which transport belt a nipping roller, bordering an exit side of the condensing zone, is disposed, wherein the friction roller is disposed on an upper roller of the front roller pair, and wherein the friction roller comprises a cleaning device for the nipping roller and/or the upper roller of the front roller pair.

31. An apparatus according to claim 30, wherein the cleaning device comprises a lamellar ring.

32. An apparatus according to claim 30, wherein the loading spring is arranged at a top arm of the drafting unit.

33. A method of retrofitting a ring spinning machine with a condensing zone, comprising:

installing a condensing unit down stream of a ring spinning machine drafting unit which has a front drafting roller pair at an exit end of the drafting unit, said condensing unit including a stationary sliding surface member with a suction slit and a belt slidable over the sliding surface, a condensing zone nipping roller drivingly engaging the transport belt and forming an exit end of the condensing zone, and installing a friction roller to be drivingly engageable with both one roller of the front drafting roller pair and the condensing zone nipping roller, wherein the nipping roller has at least two areas of differing diameters, of which one area is provided for the drive by the friction roller and the at least one other area is provided for a tension draft which acts on the fiber strand, wherein the friction roller is disposed on a flexible coating of the nipping roller, wherein the flexible coating of the nipping roller has an area which is provided for the drive by the friction roller as well as for the drive of the transport belt, and wherein the flexible coating of the nipping roller has two areas, of which one area is provided for the drive by the friction roller and the other area is provided for the drive of the transport belt.

34. A method according to claim 33, wherein the friction roller is disposed on an upper roller of the front roller pair.

35. A method according to claim 34, wherein a loading spring is arranged at a top arm of the drafting unit for loading the friction roller.

36. A method according to claim 33, wherein the friction roller is provided with an elastomer coating.

37. A method according to claim 33, wherein the friction roller is provided with a knurled or fluted steel surface.

38. A method of retrofitting a ring spinning machine with a condensing zone, comprising:

installing a condensing unit down stream of a ring spinning machine drafting unit which has a front drafting roller pair at an exit end of the drafting unit, said condensing unit including a stationary sliding surface member with a suction slit and a belt slidable over the sliding surface, a condensing zone nipping roller drivingly engaging the transport belt and forming an exit end of the condensing zone, and installing a friction roller to be drivingly engageable with both one roller of the front drafting roller pair and the condensing zone nipping roller, wherein the nipping roller has at least two areas of differing diameters, of which one area is provided for the drive by the friction roller and the at least one other area is provided for a tension draft which acts on the fiber strand, wherein the friction roller is disposed on an upper roller of the front roller pair, and wherein the friction roller comprises a cleaning device for the nipping roller and/or the upper roller of the front roller pair.

39. A method according to claim 38, wherein a loading spring is arranged at a top arm of the drafting unit for loading the friction roller.

* * * * *